US009942676B1

(12) United States Patent
Jensen et al.

(10) Patent No.: US 9,942,676 B1
(45) Date of Patent: Apr. 10, 2018

(54) METHOD AND SYSTEM OF THROTTLING A PILOT TONE FOR THERMAL MONITORING OF AN ELECTRO-MECHANICAL ACTUATOR

(71) Applicant: Apple Inc., Cupertino, CA (US)

(72) Inventors: Thomas M. Jensen, San Francisco, CA (US); David T. Yeh, San Jose, CA (US)

(73) Assignee: APPLE INC., Cupertino, CA (US)

( * ) Notice: Subject to any disclaimer, the term of this patent is extended or adjusted under 35 U.S.C. 154(b) by 258 days.

(21) Appl. No.: 14/820,354

(22) Filed: Aug. 6, 2015

Related U.S. Application Data

(63) Continuation of application No. 14/819,324, filed on Aug. 5, 2015, now abandoned.

(51) Int. Cl.
*H04R 29/00* (2006.01)

(52) U.S. Cl.
CPC ..... *H04R 29/001* (2013.01)

(58) Field of Classification Search
CPC ..... H04R 29/001; H04R 3/04; H04R 3/007
USPC ..... 381/59, 55, 94.9
See application file for complete search history.

(56) References Cited

U.S. PATENT DOCUMENTS

| | | | |
|---|---|---|---|
| 8,817,995 | B2 | 8/2014 | Huijser et al. |
| 2005/0031117 | A1 | 2/2005 | Browning et al. |
| 2013/0077795 | A1 | 3/2013 | Risbo et al. |
| 2014/0126730 | A1 | 5/2014 | Crawley et al. |

*Primary Examiner* — Vivian Chin
*Assistant Examiner* — Douglas Suthers
(74) *Attorney, Agent, or Firm* — Womble Bond Dickinson (US) LLP

(57) ABSTRACT

Method of throttling a pilot tone for thermal monitoring of an electro-mechanical actuator starts by computing a power estimate based on a driving signal. A first temperature estimate is then computed based on the power estimate. The pilot tone may be generated by adjusting a level of the pilot tone based on at least one of the power estimate or the first temperature estimate. The pilot tone is injected into the driving signal to generate a driving output signal that is outputted by an electro-mechanical actuator. Other embodiments are also described.

23 Claims, 8 Drawing Sheets

METHOD AND SYSTEM OF THROTTLING A PILOT TONE FOR THERMAL MONITORING OF AN ELECTRO-MECHANICAL ACTUATOR

CROSS REFERENCE TO RELATED APPLICATIONS

This application is a continuation of application Ser. No. 14/819,324, filed Aug. 5, 2015, which is hereby incorporated by referenced in its entirety.

FIELD

An embodiment of the invention relate generally to a system and a method throttling a pilot tone for thermal monitoring of an electro-mechanical actuator. Specifically, the system and the method monitor electro-mechanical actuator (e.g., speaker) temperature by throttling a pilot tone that is injected into the audio path. The pilot tone may be throttled based on an estimate of the temperature of the voice coil that is calculated from a power estimate computed using the audio input signal. Once the pilot tone is injected into the audio path, the system and method process the measured voltage and current signals of the speaker to determine the resistance estimate of the voice coil, which is then converted to the temperature of the voice coil.

BACKGROUND

Currently, a number of consumer electronic devices include internal speakers and are adapted to output audio signals including speech and music via speaker ports. An internal speaker comprises a speaker box and a speaker driver. The speaker box is an acoustic chamber that includes the speaker port and at least partially encloses a speaker driver. The speaker driver includes a diaphragm, a voice coil, a magnet unit and a yoke.

For audio to be played, current is applied to the speaker driver which causes the voice coil to generate heat. The voice coil in the speaker driver is coupled to the magnet unit and thus, the heat from the voice coil is transferred to the magnet unit. The amount of power that may be applied to the speaker box is limited by the resilience of the magnet unit to heat. Overheating any magnet will cause structural or mechanical damage to the magnet and may result in its demagnetization. Accordingly, the temperature of the voice coil needs to be monitored to ensure that the integrity of the speaker is maintained.

SUMMARY

Generally, the invention relates to a system and a method for monitoring the temperature of an electro-mechanical actuator using a driving signal and a pilot tone that may be throttled. For example, to determine the temperature of the electro-mechanical actuator, a pilot tone is injected into the signal path and mixed with the primary driving signal. The pilot tone allows for measurements of the voltage and current signals of the electro-mechanical actuator, which are used to determine the resistance estimate of the electro-mechanical actuator. This may further be converted to a temperature estimate via a temperature coefficient equation of electro-mechanical actuator materials. Using this temperature estimate, the output levels of the electro-mechanical actuator may be maintained within safe limits. To improve the measurements of the voltage and current signals of the electro-mechanical actuator, the pilot tone may be throttled such that the pilot tone is not static but rather it is dynamic.

In one embodiment of the invention, a method of throttling a pilot tone for thermal monitoring of an electro-mechanical actuator starts by computing a power estimate based on a driving signal. A first temperature estimate may then be computed based on the power estimate. The pilot tone may then be generated by adjusting a level of the pilot tone based on at least one of the power estimate or the first temperature estimate. In some embodiments, the pilot tone may be based on the first temperature estimate which comprises increasing the pilot tone to a first level when the first temperature estimate is above a first threshold and decreasing the pilot tone to a second level when the first temperature estimate is below a second threshold. In another embodiment, the pilot tone is based on the power estimate and comprises increasing and decreasing the pilot tone using power estimate thresholds. In another embodiment, the pilot tone is based on a signal level of the audio signal and comprises increasing and decreasing the pilot tone using signal level thresholds. The pilot tone may then be injected into the driving signal to generate a driving output signal that is outputted by the electro-mechanical actuator. In one embodiment, the driving signal is an audio signal and the electro-mechanical actuator is a speaker.

In one embodiment, a computer-readable storage medium having stored thereon instructions, which when executed by a processor, causes the processor to perform the method of throttling a pilot tone for thermal monitoring of an electro-mechanical actuator.

In another embodiment, a system of throttling a pilot tone for thermal monitoring of an electro-mechanical actuator comprises a pilot tone generator, a combiner, and the electro-mechanical actuator. The pilot tone generator includes a power estimator that receives an audio input signal and computes a power estimate based on the driving signal and a power-based temperature estimator that computes a first temperature estimate based on the power estimate. The pilot tone generator generates the pilot tone by adjusting a level of the pilot tone based on at least one of the power estimate or the first temperature estimate. The combiner injects the pilot tone into the driving signal, and generates a driving output signal that is outputted by the electro-mechanical actuator.

The above summary does not include an exhaustive list of all aspects of the present invention. It is contemplated that the invention includes all systems, apparatuses and methods that can be practiced from all suitable combinations of the various aspects summarized above, as well as those disclosed in the Detailed Description below and particularly pointed out in the claims filed with the application. Such combinations may have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. In the drawings.

DETAILED DESCRIPTION

In the following description, numerous specific details are set forth. However, it is understood that embodiments of the invention may be practiced without these specific details. In other instances, well-known circuits, structures, and techniques have not been shown to avoid obscuring the understanding of this description.

Figure 1:
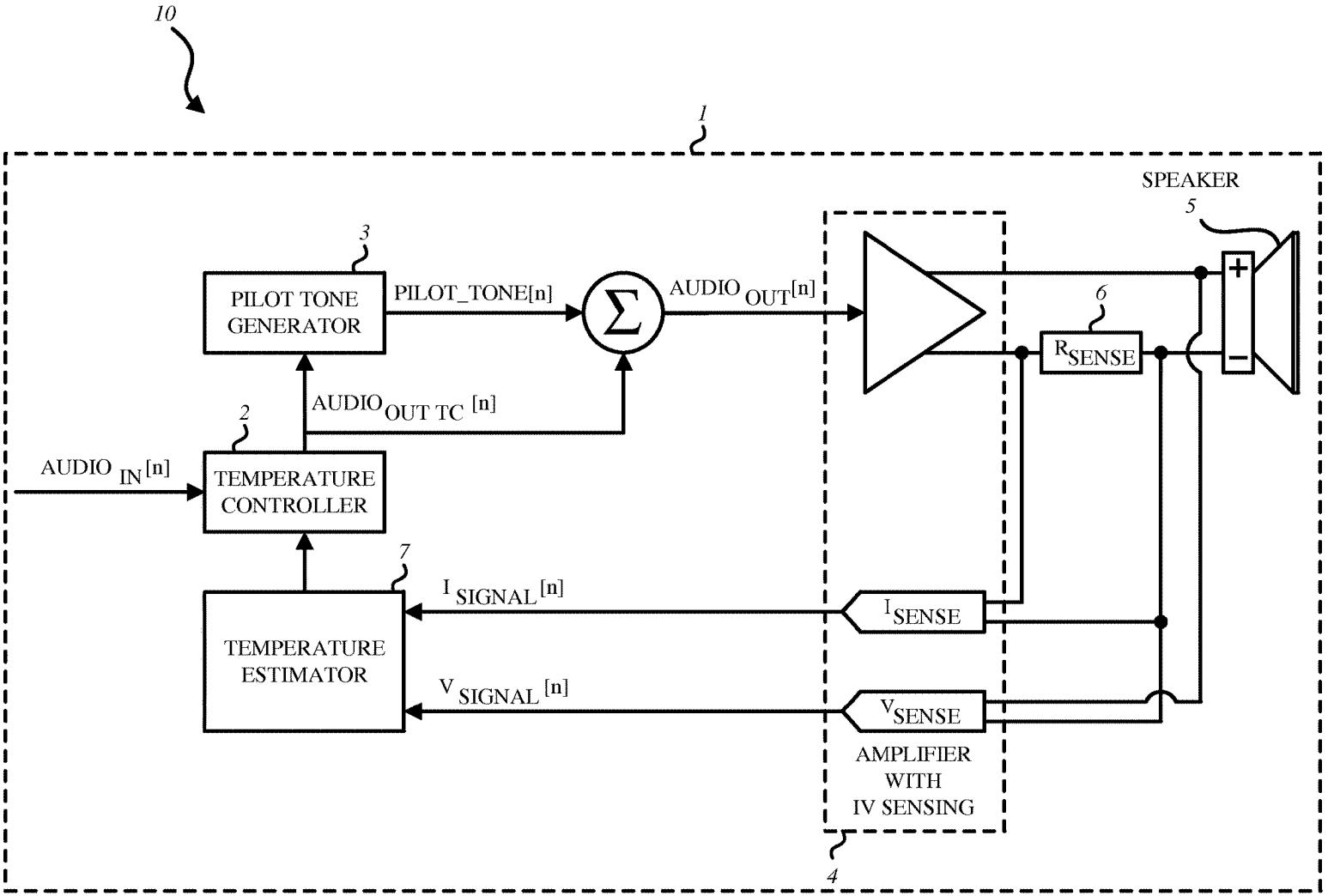
FIG. 1 illustrates a block diagram of an electronic device in which a system for throttling a pilot tone for thermal monitoring of an electro-mechanical actuator according to one embodiment of the invention may be implemented.

FIG. 1 illustrates a block diagram of an electronic device in which a system for throttling a pilot tone for thermal monitoring of an electro-mechanical actuator according to one embodiment of the invention may be implemented.

The electronic device 10 may be constrained in size and thickness and typically specifies speaker drivers in which an embodiment of the invention may be implemented. The electronic device 10 may be a mobile device such as a mobile telephone communications device or a smartphone. The electronic device 10 may also be a tablet computer, a personal digital media player or a notebook computer. The housing (also referred to as the external housing) encloses a plurality of electronic components of the electronic device 10. For example, the electronic device 10 may include electronic components such as a processor, a data storage containing an operating system and application software for execution by the processor, a display panel, and an audio codec providing audio signals to a speaker driver. The device housing has a speaker port (e.g., an acoustic port not shown). It is understood that embodiments of the invention may also be implemented in a non-mobile device such as a compact desktop computer.

In one embodiment, the electro-mechanical actuator that is being thermally monitored is a speaker. In this embodiment, as shown in FIG. 1, the system 1 for monitoring speaker temperature includes a temperature controller 2, a pilot tone generator 3, an amplifier with current (I) and voltage (V) sensing 4, a speaker 5, a resistance element 6, and a temperature estimator 7.

The system 1 monitors the temperature of the voice coil included in the speaker 5 while the speaker 5 (e.g., a dynamic loudspeaker) is being driven by an audio signal that is also referred to as the primary audio. In some embodiments, the speaker 5 may be a microspeaker used for mobile devices 10. The audio signal may be include voice, speech, sound effects, audio-visual (AV) audio, music, etc. For instance, the electronic device 10 may be adapted to receive transmissions from any content provider. An example of a "content provider" may include a company providing content for download over the Internet or other Internet Protocol (IP) based networks like an Internet service provider. In addition, the transmissions from the content providers may be a stream of digital content that is configured for transmission to one or more digital devices for viewing and/or listening. According to one embodiment, the transmission may contain MPEG (Moving Pictures Expert Group) compliant compressed video. The electronic device may also be coupled to a digital media player (e.g., DVD player) to receive and display the digital content for viewing and/or listening. Accordingly, when the user is using the electronic device 10 to listen to audio content or to view audio-visual content, the audio signal includes the audio content or the audio portion of the audio-visual content and the sound corresponding to the audio signal may be output by the speaker 5 from the speaker ports of the device 10.

In another embodiment, the electronic device 10 includes wireless communications devices having communications circuitry such as radio frequency (RF) transceiver circuitry, antennas, etc. . . . . In this embodiment, the microphone port, the speaker ports may be coupled to the communications circuitry to enable the user to participate in wireless telephone or video calls. A variety of different wireless communications networks and protocols may be supported in the wireless communications devices. These include: a cellular mobile phone network (e.g. a Global System for Mobile communications, GSM, network), including current 2G, 3G and 4G networks and their associated call and data protocols; and an IEEE 802.11 data network (WiFi or Wireless Local Area Network, WLAN) which may also support wireless voice over internet protocol (VOIP) calling. In one embodiment, the audio signal received by the system 1 includes voice signals that capture the user's speech (e.g., near-end speaker) or voice signals from the far-end speaker.

Referring back to FIG. 1, the audio input signal (e.g., $audio_{in}$ [n]) is received by the temperature controller 2 which may adjust the level of the audio signal based on a temperature estimate received from the temperature estimator 7 to output a temperature controlled audio output signal (e.g., $audio_{out\ TC}$ [n]). The pilot tone generator 3 receives the temperature controlled audio output signal ($audio_{out\ TC}$ [n]) from the temperature controller 2.

In order to obtain the temperature estimate, the pilot tone generator 3 generates a pilot tone that is injected in the audio signal. In other words, the pilot tone is mixed with the primary audio. As shown in FIG. 1, a combiner injects the pilot tone (e.g., pilot tone [n]) that is output from the pilot tone generator 3 into the temperature controlled audio output signal from the temperature controller 2. As further shown in FIG. 1, the audio signal that includes the pilot tone (e.g., $audio_{out}$ [n]) is amplified by the amplifier 4 and is outputted by the speaker 5. The pilot tone provides excitation to the speaker 5 which generates a measurable voltage signal and current signal of the speaker 5. In one embodiment, the voice coil in the speaker 5 is monitored with analog-to-digital converters for voltage across the terminals of speaker 5 and for current through the terminal of speaker 5. As shown in FIG. 1, the current and voltage sensing in the amplifier 4 may receive signals from the speaker 5 to generate the current signal (e.g., $I_{signal}$ [n]) and the voltage signal (e.g., $V_{signal}$ [n]). Using these signals from the speaker 5, the low band impedance of the voice coil (e.g., voice coil resistance estimate) may be identified and converted to obtain an estimate of the temperature of the voice coil. As further shown in FIG. 1, a resistance element 6 (e.g., resistor) may be coupled to the speaker 5 and the current and voltage sensing included in the amplifier 4. As shown in FIG. 1, the temperature estimator 7 computes the voice coil resistance estimate that estimates a resistance of the voice coil and the temperature estimate based on the voice coil resistance estimate. This voice coil resistance estimate changes while the speaker 5 is being driven by the audio signal that includes the pilot tone.

Figure 8:
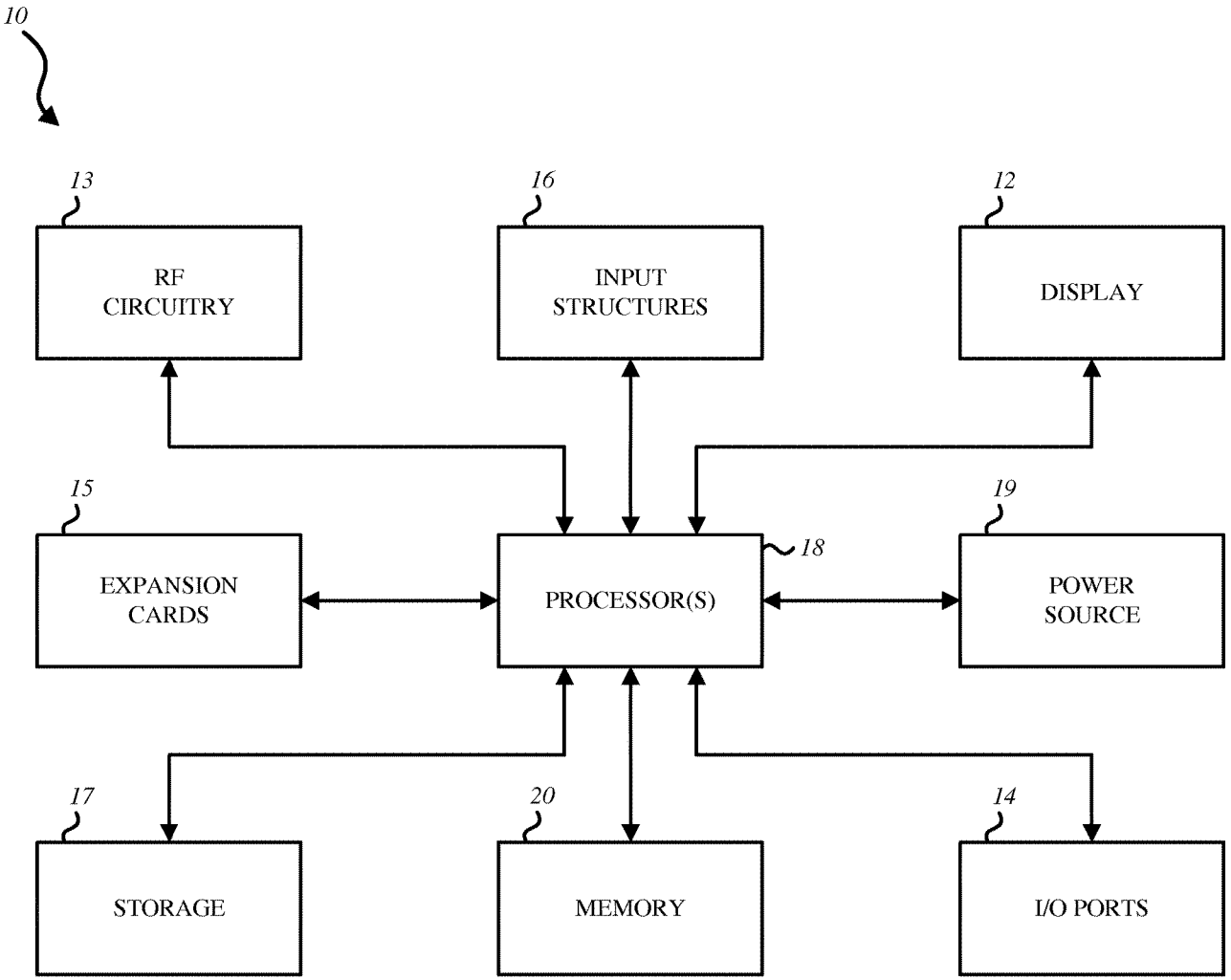
FIG. 8 is a block diagram of exemplary components of an electronic device in which the system of throttling a pilot tone for thermal monitoring of an electro-mechanical actuator may be implemented in accordance with aspects of the present disclosure.

In one embodiment, system 1 is coupled to processing circuitry and storage that is included in electronic device 10 as discussed in FIG. 8. The processing circuitry included in device 10 may include a processor 18, such as a microprocessor, a microcontroller, a digital signal processor, or a central processing unit, and other needed integrated circuits such as glue logic. The term "processor" may refer to a device having two or more processing units or elements, e.g. a CPU with multiple processing cores. The processing circuitry may be used to control the operations of device 10 by executing software instructions or code stored in the storage 17. The storage 17 may include one or more different types of storage such as hard disk drive storage, nonvolatile memory 20, and volatile memory 20 such as dynamic random access memory. In some cases, a particular function as described below may be implemented as two or more pieces of software in the storage 17 that are being executed by different hardware units of a processor. The processing circuitry may execute instructions stored in memory that causes the processing circuitry to perform the method of monitoring speaker temperature according to the embodiments as described herein. The processing circuitry may also execute instructions stored in memory that causes the processing circuitry to control the functions of each of the components of system 1 to cause the components (e.g., the temperature controller 2, pilot tone generator 3, temperature estimator 7, etc.) to perform the functions according to the embodiments as described herein.

Figure 2:
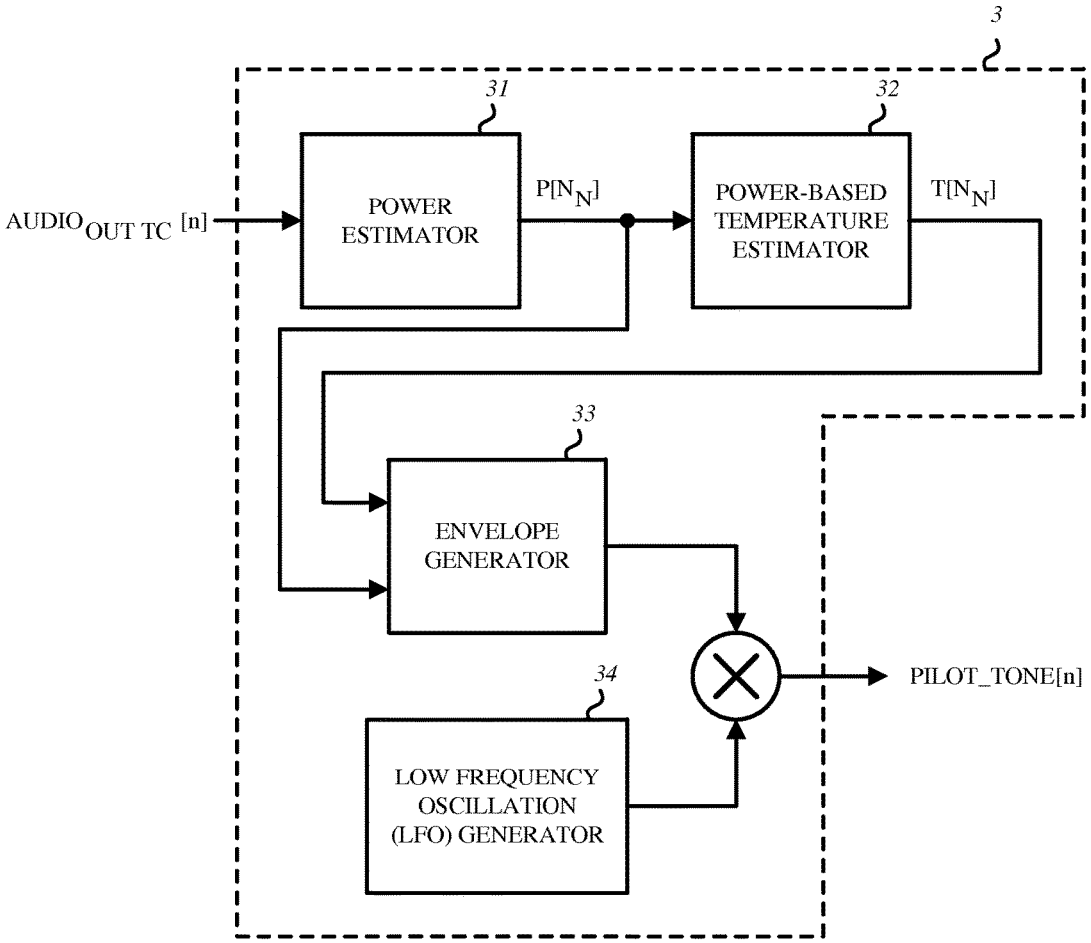
FIG. 2 illustrates a block diagram of the details of the pilot tone generator that is included in the system in FIG. 1 according to one embodiment of the invention.

FIG. 2 illustrates a block diagram of the details of the pilot tone generator 3 that is included in the system in FIG. 1 according to one embodiment of the invention. The pilot tone generator 3 includes a power estimator 31, a power-based temperature estimator 32, an envelope generator 33, and a low-frequency oscillation (LFO) generator 34. The power estimator 31 receives a temperature controlled audio output signal ($audio_{out\ TC}$ [n]) from the temperature controller 2 and computes a power estimate based on the temperature controlled audio output signal. To compute the power estimate ($P[N_N]$), the power estimator 31 computes the electrical power dissipated in the speaker 5 from the audio input given parameters to convert from digital input level to power. The power estimate is transmitted to the power-based temperature estimator 32 that computes a first temperature estimate ($T[N_N]$) based on the power estimate. To compute the first temperature estimate, the power-based temperature estimator 32 computes the transducer temperature from the electrical power.

The envelope generator 33 receives the first temperature estimate and the power estimate and determines the envelope output level based on the first temperature estimate and the power estimate. In another embodiment, in lieu of receiving the first temperature estimate from the power-based temperature estimator 32, the envelope generator 33 may obtain the temperature estimate from the temperature estimator 7 to determine the envelope output level. In one embodiment, the envelope generator 33 may include logic to determine the envelope output level. The envelope generator 33 may also smooth the envelope output level using first output smoothing to provide envelope transition and outputting an envelope output. From FIG. 3, the low frequency oscillation (LFO) generator 34 outputs an LFO that is controlled using the envelope output to generate the pilot tone. The envelope output may be in an audio rate. The LFO generator 34 may be free-running and enveloped by the envelope level to generate the pilot tone.

In one embodiment, the pilot tone may be low-level pilot tone such as, for example, a low frequency tone in a non-salient range. The pilot tone is inaudible when outputted by the speaker 5 due to the pilot tone's low level relative to the maximum drive strength of the amplifier driving the speaker 5. At the initial audio playback the low-level of the pilot tone also ensures low power consumption from the pilot tone. At this low-level frequency, the pilot tone signal-to-noise ratio (SNR) is not optimal but the pilot tone allows the temperature estimator 7 to measure the runtime estimate of the voice coil resistance (R(t)) from the current and voltage while ensuring that the pilot tone is not detectable by the listener. However, the SNR may be improved by increasing the pilot tone level when the voice coil of the speaker 5 is at a higher temperature. Further, when the listener increases the volume of the playback of the audio signal, more power will be dissipated into the speaker 5 and the voice coil will increase in temperature. Accordingly the pilot tone level may be increased gradually over time to ensure better pilot tone SNR, which provides a more robust estimate of the voice coil temperature, and is inaudible to the listener since the elevated audio playback level masks the pilot tone. Thus, the pilot tone generator 3 as described above may generate a pilot tone that is dynamic. As shown in the FIG. 3, the LFO from LFO generator 34 is enveloped by the envelope output from the envelope generator 33 that is further based on the power estimate and/or the first temperature estimate. In one embodiment, the pilot tone may be generated to be within a small window (e.g., 10 dBfs in size). Accordingly, the level of the pilot tone may be dynamically scaled (e.g., pilot tone throttling) within this small window. The size and levels established by the window may be tunable. The pilot tone may also be adjusted to be two or more levels or to be a continuous range of pilot tone levels.

Figure 3:
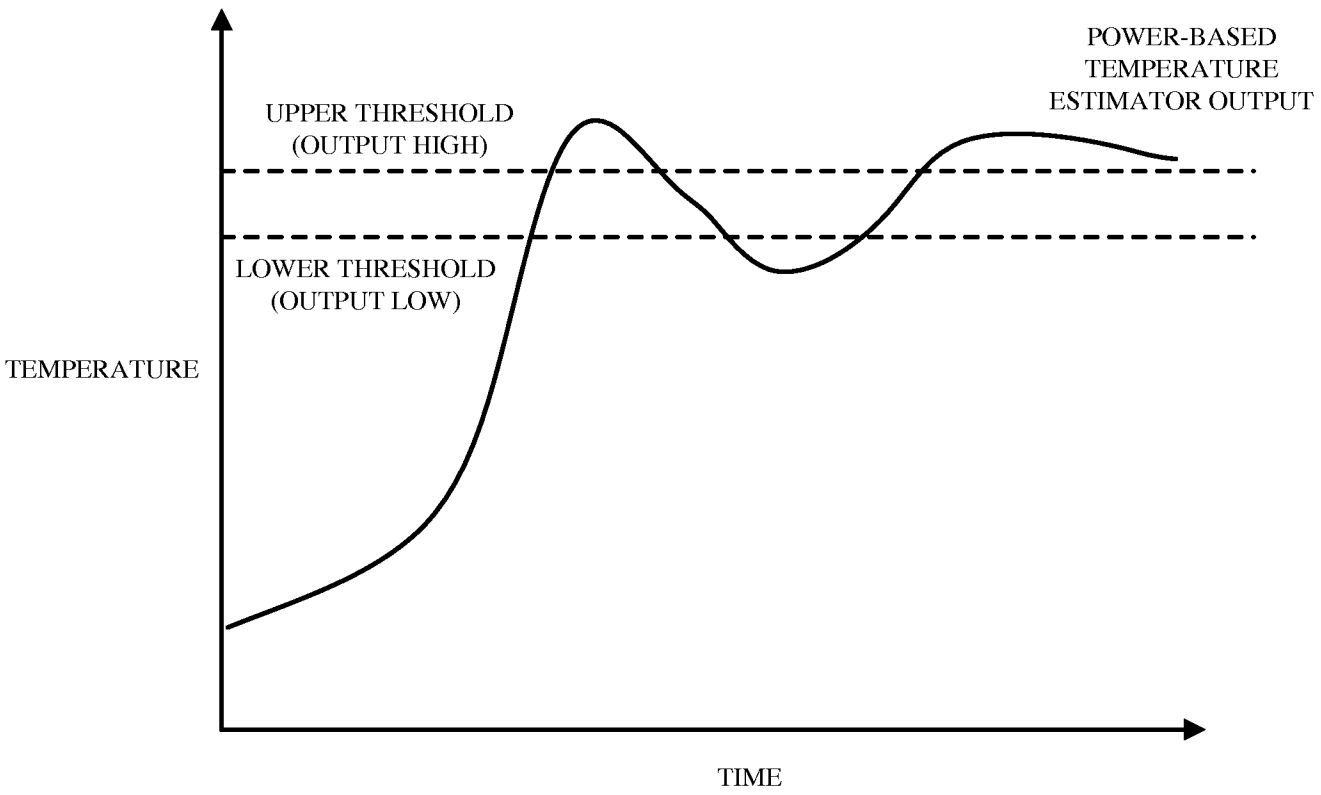
FIG. 3 illustrates an exemplary graph of the first temperature estimate generated by the pilot tone generator in FIG. 2 over time according to one embodiment of the invention.

FIG. 3 illustrates an exemplary graph of the first temperature estimate generated by the pilot tone generator 3 in FIG. 2 over time according to one embodiment of the invention. In another embodiment, the second temperature estimate generated by the temperature estimator 7 may be transmitted to the envelope generator 33 in the pilot tone generator 3 to affect the pilot tone being generated. In that embodiment, the temperature estimate from the temperature estimator 7 may also be represented in FIG. 3.

In FIG. 3, as the temperature estimate of the transducer or voice coil increases, the pilot tone generator 3 monitors the first temperature estimate with respect to an upper and lower threshold and alters the pilot tone level accordingly. For example, the pilot tone generator 3 may start by generating a pilot tone at the lower level and when the pilot tone generator 3 detects that the temperature of the voice coil of the speaker 5 is above an upper threshold, the pilot tone generator 3 may start increasing the pilot tone to the higher level. The pilot tone at higher level is higher than the pilot tone at a lower level. When the pilot tone generator 3 detects that the temperature of the voice coil of the speaker 5 is below a lower threshold, the pilot tone generator 3 may decrease the pilot tone back to the lower level. In one embodiment, the upper and lower thresholds are predetermined temperature values. A hysteresis between the upper and lower thresholds prevents unnecessary level fluctuations of the pilot tone. In another embodiment, a graph of the power estimate generated by the power estimator 31 may be similar to the graph in FIG. 3. Specifically, the pilot tone generator 3 (or the envelope generator 33 specifically) monitors the power estimate with respect to an upper and lower threshold and alters the pilot tone level accordingly. In yet another embodiment, the envelope generator 33 also receives the temperature controlled audio output signal ($audio_{out\ TC}$ [n]), monitors the signal level with respect to an upper and lower threshold and alters the pilot tone level accordingly. In one embodiment, the envelope generator 33 receives the signal level and the power estimate that are filtered.

Moreover, the following embodiments of the invention may be described as a process, which is usually depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a procedure, etc.

Figure 4:
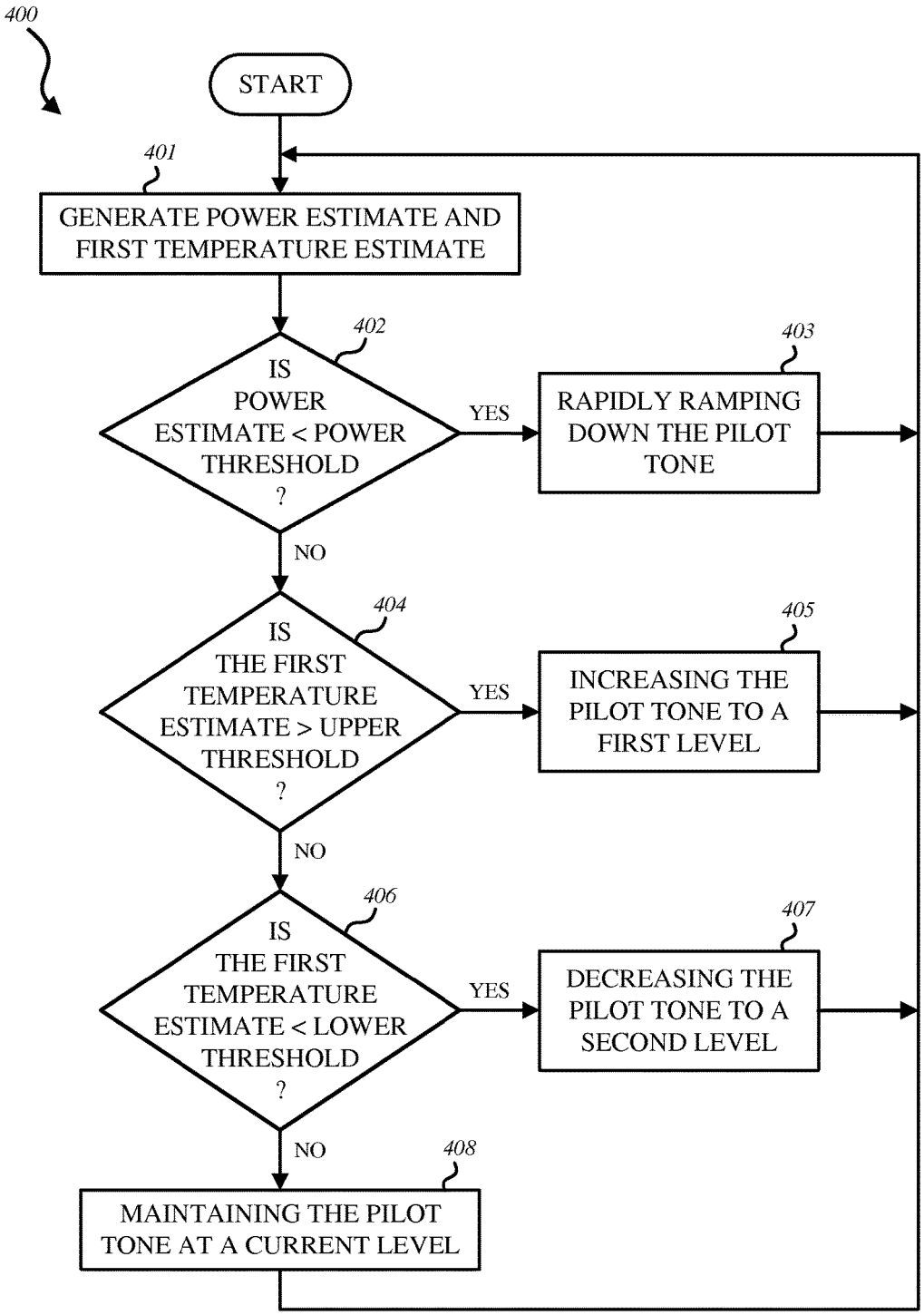
FIG. 4 illustrates a flow diagram of an example method of generating a pilot tone by the pilot tone generator in FIG. 2 according to an embodiment of the invention.

FIG. 4 illustrates a flow diagram of an example method of generating a pilot tone by the pilot tone generator 3 in FIG. 2 according to an embodiment of the invention.

The method 400 starts at Block 401 with the power estimator 31 included in the pilot tone generator 3 generating the power estimate and the power-based temperature estimator 32 included in the pilot tone generator 3 generating a first temperature estimate. At Block 402, the envelope generator 33 included in the pilot tone generator 3 determines whether the power estimate is lower than a power threshold. This determination at Block 402 allows for the pilot generator 3 to assess whether the audio stream stops. When the audio stream is stopped the pilot tone needs to be rapidly ramped down, otherwise the pilot tone may be perceptible by the listener. In order to rapidly ramp down the pilot tone, the amplitude or level of the pilot tone may be adjusted to −infinity dBfs. The audio stream is considered to be stopped, for example, when the end of the audio stream is reached, or when the user is pausing or choosing a next track through the user interface (UI), or other system interactions. The envelope generator 33 in pilot tone generator 3 may thus detect the stopping of the audio stream by calculating the power estimate of the audio signal and comparing the power estimate to a power threshold. When the power estimate is lower than the power threshold, at Block 403, the pilot tone generator 3 rapidly ramps down the pilot tone to eventually turn off the pilot tone (e.g., pilot tone level adjusted to −infinity dBfs). In one embodiment, the envelope generator 33 generates an envelope output that envelopes the LFO from LFO generator 34 such that the pilot tone is ramped down (e.g., adjusted to −infinity dBfs).

When the power estimate is not lower than the power threshold, the envelope generator 33 then determines whether the first temperature estimate is greater than the upper threshold at Block 404. If the first temperature estimate is greater than the upper threshold, at Block 405, the pilot tone generator 3 increases the pilot tone to a first level (e.g., higher level). For example, the pilot tone generator 3 may start by generating a pilot tone at the lower level and when the pilot tone generator 3 detects that the temperature of the voice coil of the speaker 5 is above an upper threshold, the pilot tone generator 3 may start increasing the pilot tone to the higher level. In one embodiment, the envelope generator 33 generates an envelope output that envelopes the LFO from LFO generator 34 such that the pilot tone is increased to the first level in Block 405. In another embodiment, at Block 404, the envelope generator 33 determines whether the power estimate is greater than the upper threshold and if so, at Block 405, the pilot tone generator 3 increases the pilot tone to a first level (e.g., higher level). In yet another embodiment, at Block 404, the envelope generator 33 determines whether the signal level is greater than the upper threshold and if so, at Block 405, the pilot tone generator 3 increases the pilot tone to a first level (e.g., higher level).

At Block 406, the envelope generator 33 determines whether the first temperature estimate is lower than a lower threshold. If the first temperature estimate is lower than the lower threshold, at Block 407, the pilot tone generator 3 decreases the pilot tone to the second level (e.g., lower level). For example, when the pilot tone generator 3 detects that the temperature of the voice coil of the speaker 5 is below a lower threshold, the pilot tone generator 3 may decrease the pilot tone back to the lower level. In one embodiment, the envelope generator 33 generates an envelope output that envelopes the LFO from LFO generator 34 such that the pilot tone is decreased to the second level in Block 407. When the first temperature estimate is not lower than the lower threshold in Block 406, the pilot tone generator 3 maintains the pilot tone at a current level. In one embodiment, the envelope generator 33 continues to generate the current envelope output that envelopes the LFO from LFO generator 34 such that the pilot tone is maintained at the current level in Block 408. In another embodiment, at Block 406, the envelope generator 33 determines whether the power estimate is lower than the lower threshold and if so, at Block 407, the pilot tone generator 3 decreases the pilot tone to a second level (e.g., lower level). In yet another embodiment, at Block 406, the envelope generator 33 determines whether the signal level is lower than the lower threshold and if so, at Block 407, the pilot tone generator 3 increases the pilot tone to a second level (e.g., lower level).

Referring back to FIG. 1, once the pilot tone from the pilot tone generator 3 is injected in the audio signal from the temperature controller 2 and amplified by amplifier 4, the pilot tone provides excitation to the speaker 5 that allows the voice coil in the speaker 5 to be monitored with current and voltage sensing included in the amplifier 4. The temperature estimator 7 receives the voltage signal and the current signal from the amplifier 4 in parallel.

Figure 5:
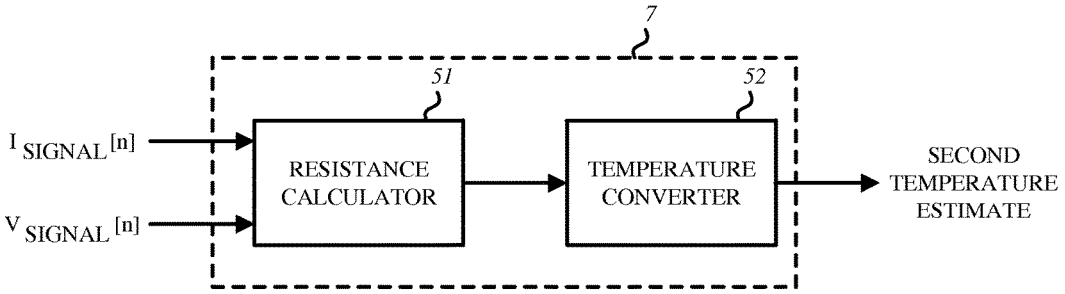
FIG. 5 illustrates a block diagram of the details of the temperature estimator that is included in the system in FIG. 1 and that provides the second temperature estimate according to one embodiment of the invention.

FIG. 5 illustrates a block diagram of the details of the temperature estimator 7 that is included in the system in FIG. 1 according to one embodiment of the invention. The temperature estimator 7 comprises the resistance calculator 51 and the temperature converter 52.

The resistance calculator 51 then receives the voltage signal ($V_{SIGNAL}$ [n]) and the current signal ($I_{SIGNAL}$[n]). The resistance calculator 51 then computes the voice coil resistance estimate. The resistance calculator 51 may compute the voice coil resistance estimate (R[n]) using:

$$R[n]=V_{SIGNAL}[n]/I_{SIGNAL}[n].$$

The temperature converter 52 then receives the voice coil resistance estimate (R[n]) and computes the temperature estimate of the voice coil (T[n]) based on the voice coil resistance estimate. In one embodiment, the voice coil resistance estimate (R[n]) is converted into the temperature estimate using a temperature coefficient equation of voice coil materials such as:

$$T[n]=1/\alpha*(R[n]/R_{REF}[n]-1)+T_{REF}[n]$$

where T[n] is the voice coil temperature estimate, R[n] is run time estimate of voice coil resistance, $R_{REF}$ is voice coil resistance reference at voice coil reference temperature $T_{REF}$, and a is voice coil wire thermal coefficient of resistivity. The temperature estimator may read $R_{REF}$ and $T_{REF}$ from memory.

Referring back to FIG. 1, the temperature estimator 7 outputs the temperature estimate to the temperature controller 2 which monitors the temperature estimate and adjusts the level of the audio signal based on the temperature estimate to ensure that the output level of the speaker 5 are within safe limits. For instance, the temperature controller 2 may decrease the level of the audio signal ($audio_{in}$[n]) to output the $audio_{out\ TC}$ [n] when the temperature controller 2 determines that the temperature estimate is above a temperature threshold that is indicates that the temperature of the voice coil is above an acceptable limit.

Figure 6:
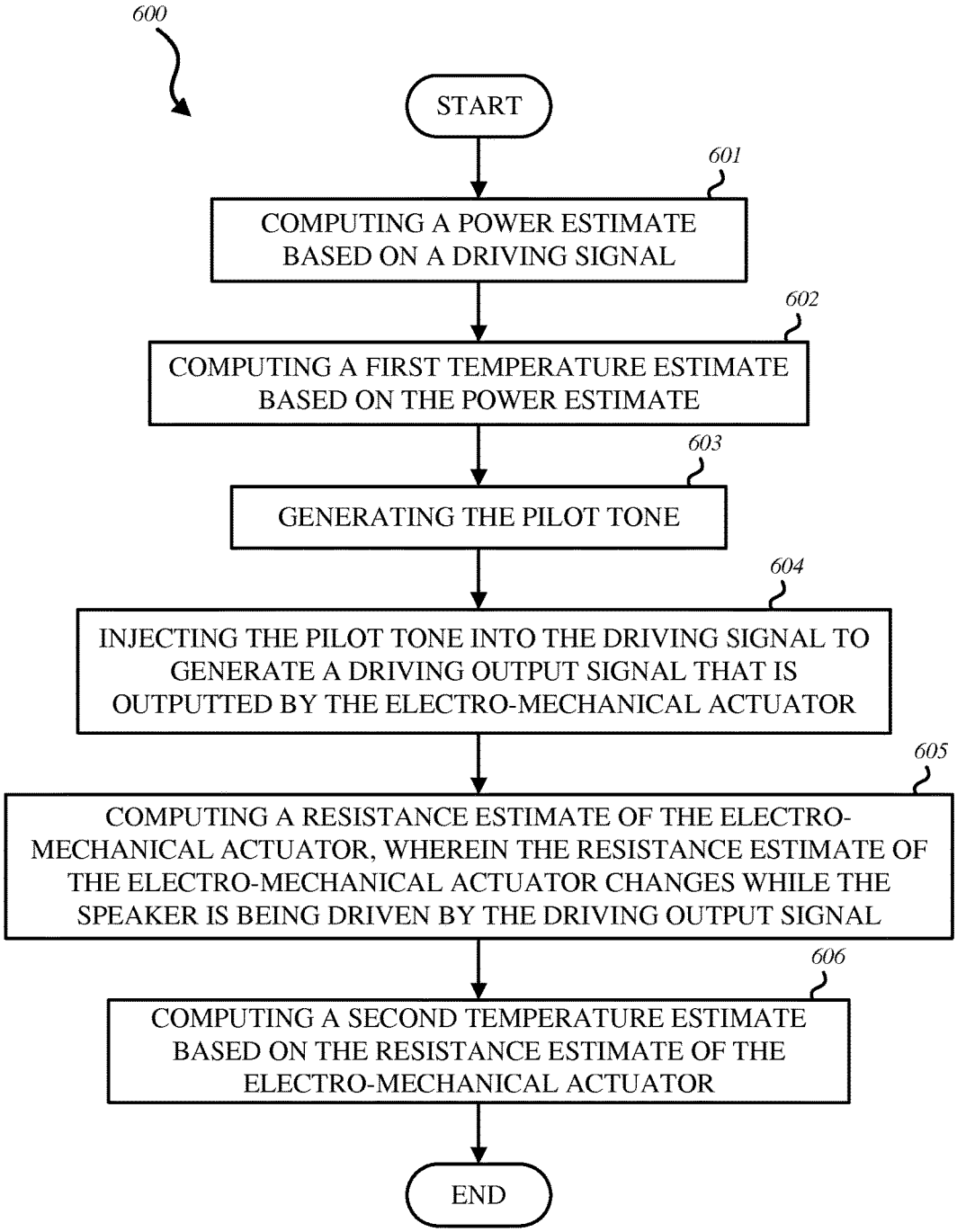
FIG. 6 illustrates a flow diagram of the details of a method of throttling a pilot tone for thermal monitoring of an electro-mechanical actuator according to an embodiment of the invention.

FIG. 6 illustrates a flow diagram of the details of a method 600 of throttling a pilot tone for thermal monitoring of an electro-mechanical actuator according to an embodiment of the invention. The method 600 starts with a pilot tone generator 3 computing a power estimate based on a driving signal at Block 601. In one embodiment, the electro-mechanical actuator is an audio signal that may be a temperature controlled audio output signal ($audio_{out\ TC}$ [n]) from the temperature controller 2. At Block 602, the pilot tone generator 3 computes the first temperature estimate based on the power estimate. At Block 603, the pilot tone generator 3 generates the pilot tone. At Block 604, the pilot tone is injected by the pilot tone generator 3 into the driving signal to generate a driving output signal that is outputted by the electro-mechanical actuator. In one embodiment, the driving output signal is an audio output signal that is outputted by a speaker 5. At Block 605, the temperature estimator 7 estimates the resistance estimate of the electro-mechanical actuator. The resistance estimate of the electro-mechanical actuator changes while the electro-mechanical actuator is being driven by the driving signal. In one embodiment, the resistance estimate of the electro-mechanical actuator is a voice coil resistance estimate. The voice coil resistance estimate estimates the resistance of the voice coil of the speaker 5 and changes while the speaker 5 is being driven by the audio output signal. At 606, the temperature estimator 7 computes the second temperature estimate based on the resistance estimate of the electro-mechanical actuator. In one embodiment, the temperature estimator 7 computes the second temperature estimate based on the voice coil resistance estimate. The second temperature estimate may be used by the system 1 or the electronic device 10 to control various functions of the system 1 or the electronic device. For example, the temperature controller 2 may adjust the level of the driving signal or the audio input signal based on the second temperature estimate. This enables the output of the temperature controller 2 (e.g., $audio_{out\ TC}$ [n]) to be at a level that maintains the integrity of the speaker 5.

Figure 7:
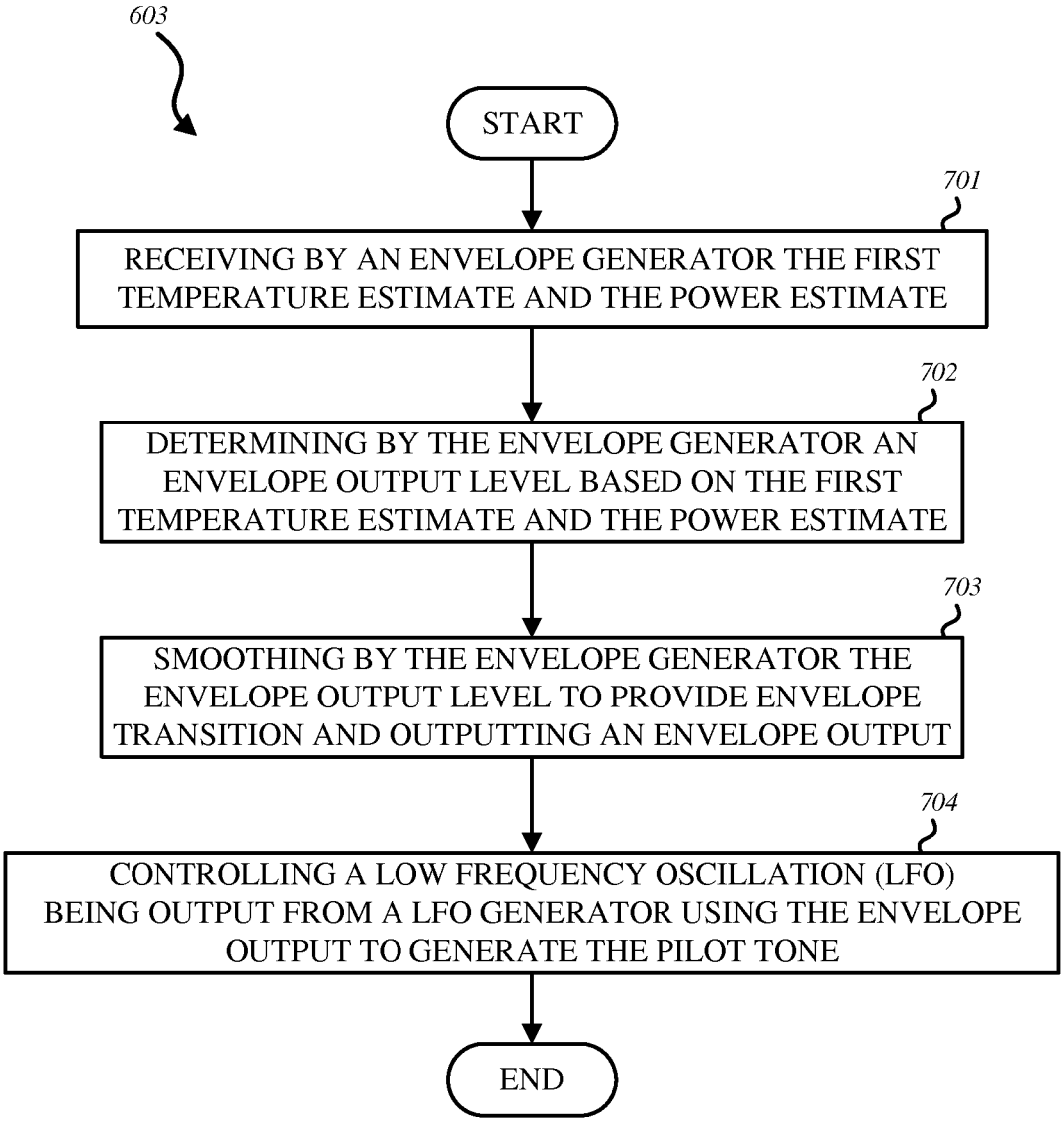
FIG. 7 illustrates a flow diagram of the details of generating the pilot tone in Block 603 of the example method in FIG. 6 of throttling a pilot tone for thermal monitoring of an electro-mechanical actuator according to an embodiment of the invention.

FIG. 7 illustrates a flow diagram of the details of generating the pilot tone in Block 603 of the example method in FIG. 6 of throttling a pilot tone for thermal monitoring of an electro-mechanical actuator according to an embodiment of the invention. At Block 701, the envelope generator 33 in the pilot tone generator 3 receives the first temperature estimate and the power estimate. At Block 702, the envelope generator 33 determines an envelope output level based on the first temperature estimate and the power estimate. At Block 703, the envelope generator 33 smoothens the envelope output level to provide envelope transition and outputting an envelope output. At Block 704, the low-frequency oscillation (LFO) being output from a LFO generator is controlled (or enveloped) using the envelope output to generate the pilot tone. The envelope output may be in an audio rate.

FIG. 8 is a block diagram of exemplary components of an electronic device 10 in which the system 1 of throttling a pilot tone for thermal monitoring of an electro-mechanical actuator may be implemented in accordance with aspects of the present disclosure. A general description of suitable electronic devices for performing these functions is provided below with respect to FIG. 8. Specifically, FIG. 8 is a block diagram depicting various components that may be present in electronic devices suitable for use with the present techniques. The electronic device 10 may be in the form of a computer, a handheld portable electronic device, and/or a computing device having a tablet-style form factor. These types of electronic devices, as well as other electronic devices providing comparable functionalities may be used in conjunction with the present techniques.

Keeping the above points in mind, FIG. 8 is a block diagram illustrating components that may be present in one such electronic device 10, and which may allow the device 10 to function in accordance with the techniques discussed herein. The various functional blocks shown in FIG. 8 may include hardware elements (including circuitry), software elements (including computer code stored on a computer-readable medium, such as a hard drive or system memory), or a combination of both hardware and software elements. It should be noted that FIG. 8 is merely one example of a particular implementation and is merely intended to illustrate the types of components that may be present in the electronic device 10. For example, in the illustrated embodiment, these components may include a display 12, input/output (I/O) ports 14, input structures 16, one or more processors 18, memory device(s) 20, non-volatile storage 17, expansion card(s) 15, RF circuitry 13, and power source 19.

In the embodiment of the electronic device 10 in the form of a computer, the embodiment include computers that are generally portable (such as laptop, notebook, tablet, and handheld computers), as well as computers that are generally used in one place (such as conventional desktop computers, workstations, and servers).

The electronic device 10 may also take the form of other types of devices, such as mobile telephones, media players, personal data organizers, handheld game platforms, cameras, and/or combinations of such devices. For instance, the device 10 may be provided in the form of a handheld electronic device that includes various functionalities (such as the ability to take pictures, make telephone calls, access the Internet, communicate via email, record audio and/or video, listen to music, play games, connect to wireless networks, and so forth).

In another embodiment, the electronic device 10 may also be provided in the form of a portable multi-function tablet computing device. In certain embodiments, the tablet computing device may provide the functionality of media player, a web browser, a cellular phone, a gaming platform, a personal data organizer, and so forth.

An embodiment of the invention may be a machine-readable medium having stored thereon instructions which program a processor to perform some or all of the operations described above. A machine-readable medium may include any mechanism for storing or transmitting information in a form readable by a machine (e.g., a computer), such as Compact Disc Read-Only Memory (CD-ROMs), Read-Only Memory (ROMs), Random Access Memory (RAM), and Erasable Programmable Read-Only Memory (EPROM). In other embodiments, some of these operations might be performed by specific hardware components that contain hardwired logic. Those operations might alternatively be performed by any combination of programmable computer components and fixed hardware circuit components. In one embodiment, the machine-readable medium includes instructions stored thereon, which when executed by a processor, causes the processor to perform the method of throttling a pilot tone for thermal monitoring of an electro-mechanical actuator as described above.

In the description, certain terminology is used to describe features of the invention. For example, in certain situations, the terms "component," "unit," "module," and "logic" are representative of hardware and/or software configured to perform one or more functions. For instance, examples of "hardware" include, but are not limited or restricted to an integrated circuit such as a processor (e.g., a digital signal processor, microprocessor, application specific integrated circuit, a micro-controller, etc.). Of course, the hardware may be alternatively implemented as a finite state machine or even combinatorial logic. An example of "software" includes executable code in the form of an application, an applet, a routine or even a series of instructions. The software may be stored in any type of machine-readable medium.

While the invention has been described in terms of several embodiments, those of ordinary skill in the art will recognize that the invention is not limited to the embodiments described, but can be practiced with modification and alteration within the spirit and scope of the appended claims. The description is thus to be regarded as illustrative instead of limiting. There are numerous other variations to different aspects of the invention described above, which in the interest of conciseness have not been provided in detail. Accordingly, other embodiments are within the scope of the claims.

What is claimed is:

1. A method of throttling a pilot tone for temperature monitoring comprising:

determining a power estimate based on a driving signal, wherein the power estimate represents electrical power dissipated in an electro-mechanical actuator;

determining a first temperature estimate based on the power estimate, wherein the first temperature estimate is a power-based temperature estimate of the electro-mechanical actuator;

generating the pilot tone by adjusting a level of the pilot tone based on at least one of the power estimate or the first temperature estimate; and injecting the pilot tone into the driving signal to generate a driving output signal that is outputted by the electro-mechanical actuator.

2. The method of claim 1, wherein generating the pilot tone is based on the first temperature estimate and comprises increasing the pilot tone to a first level when the first temperature estimate is above a first threshold and decreasing the pilot tone to a second level when the first temperature estimate is below a second threshold.

3. The method of claim 1, wherein generating the pilot tone is based on the power estimate and comprises increasing the pilot tone to a first level when the power estimate is above a first threshold and decreasing the pilot tone to a second level when the power estimate is below a second threshold.

4. The method of claim 1, wherein generating the pilot tone is based on a signal level of the driving signal and comprises increasing the pilot tone to a first level when the signal level is above a first threshold and decreasing the pilot tone to a second level when the signal level is below a second threshold.

5. The method of claim 1, wherein generating the pilot tone further comprises generating the pilot tone based on the power estimate, wherein the pilot tone level is rapidly ramped down when the power estimate is lower than a power threshold.

6. The method of claim 1, wherein generating the pilot tone comprises:

receiving by an envelope generator the first temperature estimate and the power estimate;

determining by the envelope generator an envelope output level based on the first temperature estimate and the power estimate; and smoothing by the envelope generator the envelope output level to provide envelope transition and outputting an envelope output.

7. The method of claim 6, wherein generating the pilot tone comprises:

enveloping a low frequency oscillation (LFO) being output from a LFO generator using the envelope output to generate the pilot tone.

8. The method of claim 1, further comprising:

determining a voice coil resistance estimate that estimates a resistance of a voice coil of a speaker, wherein the voice coil resistance estimate changes while the speaker is being driven by an audio output signal, wherein the driving signal is an audio signal, the driving output signal is the audio output signal, the electro-mechanical actuator is the speaker;

determining a second temperature estimate based on the voice coil resistance estimate; and adjusting a level of the audio input signal based on the second temperature estimate.

9. The method of claim 8, wherein determining the voice coil resistance estimate comprises:

receiving a voltage signal and a current signal in parallel from an amplifier with current and voltage sensing coupled to the speaker;

determining the voice coil resistance based on the voltage signal and the current signal.

10. A system of throttling a pilot tone for temperature monitoring comprising:

a pilot tone generator that comprises:

a power estimator to receive a driving signal and to determine a power estimate based on the driving signal, wherein the power estimate is electrical power dissipated in an electro-mechanical actuator, a power-based temperature estimator to determine a first temperature estimate based on the power estimate, wherein the first temperature estimate is a power-based temperature estimate of the electro-mechanical actuator, and wherein the pilot tone generator generates the pilot tone by adjusting a level of the pilot tone based on at least one of the power estimate or the first temperature estimate;

a combiner to inject the pilot tone into the driving signal, and to generate a driving output signal; and the electro-mechanical actuator to output the driving output signal.

11. The system of claim 10, wherein the pilot tone generator generates the pilot tone is based on the first temperature estimate and comprises increasing the pilot tone to a first level when the first temperature estimate is above a first threshold and decreasing the pilot tone to a second level when the first temperature estimate is below a second threshold.

12. The system of claim 10, wherein the pilot tone generator generates the pilot tone is based on the power estimate and comprises increasing the pilot tone to a first level when the power estimate is above a first threshold and decreasing the pilot tone to a second level when the power estimate is below a second threshold.

13. The system of claim 10, wherein the pilot tone generator generates the pilot tone is based on a signal level of the driving signal and comprises increasing the pilot tone to a first level when the signal level is above a first threshold and decreasing the pilot tone to a second level when the signal level is below a second threshold.

14. The system of claim 10, wherein the pilot tone generator further generates the pilot tone based on the power estimate, wherein the pilot tone level is rapidly ramped down when the power estimate is lower than a power threshold.

15. The system of claim 10, wherein the pilot tone generator further comprises:

an envelope generator to receive the first temperature estimate and the power estimate, to determine an envelope output level based on the first temperature estimate and the power estimate, and to smooth the envelope output level to provide envelope transition and outputting an envelope output.

16. The system of claim 15, wherein the pilot tone generator generates the pilot tone by:

enveloping a low frequency oscillation (LFO) being output from a LFO generator using the envelope output to generate the pilot tone.

17. The system of claim 10, further comprising:

an amplifier with current and voltage sensing coupled to a speaker to receive and amplify an audio output signal that is transmitted to the speaker;

to generate a current signal and a voltage signal based on signals from the speaker, wherein the driving signal is an audio signal, the driving output signal is the audio output signal, the electro-mechanical actuator is the speaker;

a temperature estimator to receive the current signal and the voltage signal in parallel from the amplifier, to determine a voice coil resistance based on the voltage signal and the current signal, wherein the voice coil resistance estimate estimates a resistance of a voice coil of the speaker, and to generate a second temperature estimation based on the voice coil resistance; and a temperature controller to adjust a level of the driving signal based on the second temperature estimate.

18. A non-transitory computer-readable storage medium having stored thereon instructions, when executed by a processor, causes the processor to perform a method of throttling a pilot tone for temperature monitoring comprising:

determining a power estimate based on a driving signal, wherein the power estimate is electrical power dissipated in an electro-mechanical actuator;

determining a first temperature estimate based on the power estimate, wherein the first temperature estimate is a power-based temperature estimate of the electro-mechanical actuator;

generating the pilot tone by adjusting a level of the pilot tone based on at least one of the power estimate or the first temperature estimate; and injecting the pilot tone into the driving signal to generate a driving output signal that is outputted by the electro-mechanical actuator.

19. The non-transitory computer-readable storage medium of claim 18, wherein generating the pilot tone is based on the first temperature estimate and comprises increasing the pilot tone to a first level when the first temperature estimate is above a first threshold and decreasing the pilot tone to a second level when the first temperature estimate is below a second threshold.

20. The non-transitory computer-readable storage medium of claim 18, wherein generating the pilot tone is based on the power estimate and comprises increasing the pilot tone to a first level when the power estimate is above a first threshold and decreasing the pilot tone to a second level when the power estimate is below a second threshold.

21. The non-transitory computer-readable storage medium of claim 18, wherein generating the pilot tone is based on a signal level of the driving signal and comprises increasing the pilot tone to a first level when the signal level is above a first threshold and decreasing the pilot tone to a second level when the signal level is below a second threshold.

22. The non-transitory computer-readable storage medium of claim 18, wherein generating the pilot tone further comprises generating the pilot tone based on the power estimate, wherein the pilot tone is rapidly ramped down when the power estimate is lower than a power threshold.

23. The non-transitory computer-readable storage medium of claim 18, wherein generating the pilot tone further comprises:

receiving by an envelope generator the first temperature estimate and the power estimate;

determining by the envelope generator an envelope output level based on the first temperature estimate and the power estimate;

smoothing by the envelope generator the envelope output level to provide envelope transition and outputting an envelope output; and enveloping a low frequency oscillation (LFO) being output from a LFO generator using the envelope output to generate the pilot tone.

* * * * *